US010605040B2

(12) United States Patent
Hardesty et al.

(10) Patent No.: US 10,605,040 B2
(45) Date of Patent: Mar. 31, 2020

(54) LARGE-BORE DOWNHOLE ISOLATION TOOL WITH PLASTICALLY DEFORMABLE SEAL AND METHOD

(71) Applicant: GEODYNAMICS, INC., Millsap, TX (US)

(72) Inventors: John T. Hardesty, Fort Worth, TX (US); Michael Wroblicky, Weatherford, TX (US); Philip M. Snider, Houston, TX (US); David S. Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 16/152,685

(22) Filed: Oct. 5, 2018

(65) Prior Publication Data

US 2019/0106961 A1 Apr. 11, 2019

Related U.S. Application Data

(60) Provisional application No. 62/569,497, filed on Oct. 7, 2017.

(51) Int. Cl.
*E21B 33/128* (2006.01)
*E21B 33/129* (2006.01)
*E21B 33/12* (2006.01)

(52) U.S. Cl.
CPC ..... *E21B 33/128* (2013.01); *E21B 33/1208* (2013.01); *E21B 33/1293* (2013.01)

(58) Field of Classification Search
CPC ..... E21B 33/134; E21B 33/1291
See application file for complete search history.

(56) References Cited

U.S. PATENT DOCUMENTS 3,623,551 A * 11/1971 Randermann, Jr. ..... E21B 33/1293 166/134
2013/0048271 A1 2/2013 VanLue
2013/0299192 A1* 11/2013 Xu ..... E21B 23/01 166/382
2014/0158378 A1 6/2014 Xu et al.
2015/0013996 A1* 1/2015 Davies ..... E21B 33/134 166/382
2015/0184485 A1 7/2015 Xu et al.
2016/0186511 A1 6/2016 Coronado et al.
2017/0268310 A1* 9/2017 Shkurti ..... E21B 33/134

FOREIGN PATENT DOCUMENTS

WO 2016160003 A1 10/2016

OTHER PUBLICATIONS

International Search Report and Written Opinion in International Application No. PCT/US2018/054539 dated Dec. 11, 2018.

* cited by examiner

*Primary Examiner* — D. Andrews
(74) *Attorney, Agent, or Firm* — Patent Portfolio Builders PLLC

(57) ABSTRACT

A downhole isolation tool for sealing a well, the downhole isolation tool including a sealing element having an internal surface that defines a bore of the downhole isolation tool. The sealing element includes a plastically deformable material that irreversibly deforms when swaged.

34 Claims, 17 Drawing Sheets

LARGE-BORE DOWNHOLE ISOLATION TOOL WITH PLASTICALLY DEFORMABLE SEAL AND METHOD

BACKGROUND

Technical Field

Embodiments of the subject matter disclosed herein generally relate to downhole tools related to perforating and/or fracturing operations, and more specifically, to a large-bore downhole isolation tool that has no interior mandrel for supporting a plastically deformable seal.

Discussion of the Background

In the oil and gas field, once a well 100 is drilled to a desired depth H relative to the surface 110, as illustrated in FIG. 1, and the casing 102 protecting the wellbore 104 has been installed and cemented in place, it is time to connect the wellbore 104 to the subterranean formation 106 to extract the oil and/or gas. This process of connecting the wellbore to the subterranean formation may include a step of plugging the well with a plug 112, a step of perforating the casing 102 with a perforating gun assembly 114 such that various channels 116 are formed to connect the subterranean formations to the inside of the casing 102, a step of removing the perforating gun assembly, and a step of fracturing the various channels 116.

Some of these steps require to lower in the well 100 a wireline 118 or equivalent tool, which is electrically and mechanically connected to the perforating gun assembly 114, and to activate the gun assembly and/or a setting tool 120 attached to the perforating gun assembly. Setting tool 120 is configured to hold the plug 112 prior to plugging the well and then to set the plug. FIG. 1 shows the setting tool 120 disconnected from the plug 112, indicating that the plug has been set inside the casing and the setting tool 120 has been disconnected from the plug 112.

FIG. 1 shows the wireline 118, which includes at least one electrical connector, being connected to a control interface 122, located on the ground 110, above the well 100. An operator of the control interface may send electrical signals to the perforating gun assembly and/or setting tool for (1) setting the plug 112 and (2) disconnecting the setting tool from the plug. A fluid 124, (e.g., water, water and sand, fracturing fluid, etc.) may be pumped by a pumping system 126, down the well, for moving the perforating gun assembly and the setting tool to a desired location, e.g., where the plug 112 needs to be deployed, and also for fracturing purposes.

The above operations may be repeated multiple times for perforating and/or fracturing the casing at multiple locations, corresponding to different stages of the well. Note that in this case, multiple plugs 112 and 112' may be used for isolating the respective zones from each other during the perforating phase and/or fracturing phase.

These completion operations may require several plugs run in series or several different plug types run in series. For example, within a given completion and/or production activity, the well may require several hundred plugs depending on the productivity, depths, and geophysics of each well. Subsequently, production of hydrocarbons from these zones requires that the sequentially set plugs be removed from the well. In order to reestablish flow past the existing plugs, an operator must remove and/or destroy the plugs by milling, drilling, or dissolving the plugs.

A typical frac plug for such operations is illustrated in FIG. 2 and include various composite parts, for which reason, this type of plug is called composite plug. For example, the frac plug 200 has a central, interior, mandrel 202 on which all the other elements are placed. The mandrel acts as the backbone of the entire frac plug. The following elements are typically added over the mandrel 202: a top push ring 203, upper slip ring 204, upper wedge 206, elastic sealing element 208, lower wedge 210, lower slip ring 212, a bottom push ring 216, and a mule shoe 218. When the setting tool (not shown) applies a force on the push ring 203 on one side and applies an opposite force on the bottom push ring 216 from the other side, the intermediate components press against each other causing the sealing element 208 to elastically expand radially and seal the casing. Upper and lower wedges 206 and 210 press not only on the seal 208, but also on their corresponding slip rings 204 and 212, separating them into plural parts and at the same time forcing the separated parts of the slip rings to press radially against the casing. In this way, the slip rings maintain the sealing element into a tension state to seal the well and prevent the elastic sealing element from returning to its initial position. Note that in its initial position, the elastic sealing element does not contact the entire inner circumference of the casing to seal it. When the upper and lower wedges 206 and 210 swage the elastic sealing element to seal the casing, the elastic sealing element elastically deforms and presses against the entire circumference of the casing. However, because this deformation of the sealing element is elastic, the natural tendency of the sealing element is to return to its initial position, which is free of compression. To prevent this, the slip rings 204 and 212 are engaged with the casing and the high friction between these elements and the casing prevents the elastic sealing element from returning to its relaxed (not compressed) position. For this reason, the typical frac plug needs two slip rings, one on each side of the elastic sealing element.

A disadvantage of the typical frac plug is the small internal diameter of the passage through the mandrel 202. This is so because the mandrel takes most of the space inside the frac plug. The mandrel of the existing frac plugs needs to be strong to withstand the push from the elastic sealing element when this element is sandwiched between the upper and lower wedges 206 and 210. Note that when this happens, the elastic sealing element 208 is equally pushing against the casing of the well and against the mandrel. Thus, the force with which the elastic sealing element is pressing against the casing of the well is also felt by the mandrel, and for this reason, the mandrel needs to be made very strong. The toughness of the mandrel is usually achieved by making the walls of the mandrel thick, which means that the internal passage through the mandrel is small. This is especially so given the fact that the internal diameter of the well's casing is up to 5 inches, and thus, when the thicknesses of the elements stacked on top the mandrel are taken into account and the thickness of the mandrel itself, very little room is left for the internal passage.

However, the operator of the frac plug would prefer that the internal passage through the frac plug is large, so that a volume of fluid moving through the well is not impeded by the small diameter mandrel. In addition, when the frac plug needs to be removed, a significant amount of time is wasted to drill out the plug due to the amount of material found in the various elements of the plug and due to the thickness of the mandrel.

Thus, there is a need to provide a better plug that has a large diameter internal passage and has fewer and thinner components so that the plug can be easily and quickly drilled out.

SUMMARY

According to an embodiment, there is a downhole isolation tool for sealing a well. The downhole isolation tool includes a sealing element having an internal surface that defines a bore of the downhole isolation tool. The sealing element includes a plastically deformable material that irreversibly deforms when swaged.

According to another embodiment, there is a downhole isolation tool for sealing a well. The downhole isolation tool includes a sealing element having an internal surface that defines a bore of the downhole isolation tool; a top wedge element having a downstream end located within the sealing element; a central body that has a shoulder configured to accommodate a downstream end of the sealing element; a shoe; and a slip element that is partially located over an exterior circumference of a downstream end of the central body. The sealing element includes a plastically deformable material that irreversibly deforms when swaged.

According to still another embodiment, there is a method for setting a downhole isolation tool in a casing of a well. The method includes attaching the downhole isolation tool to a mandrel of a setting tool, lowering the downhole isolation tool and the setting tool to a desired depth inside the casing, actuating the setting tool so that the mandrel is pulled toward a sleeve of the setting tool, to plastically deform a sealing element of the downhole isolation tool. The sealing element has an internal surface that defines a bore of the downhole isolation tool, and the sealing element includes a plastically deformable material that irreversibly deforms when swaged by the sleeve and the mandrel.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a large-bore composite plug. However, the embodiments discussed herein are applicable to a downhole isolation tool or to isolation tools (e.g., plugs) that are not made of composite materials or do not have a large bore.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
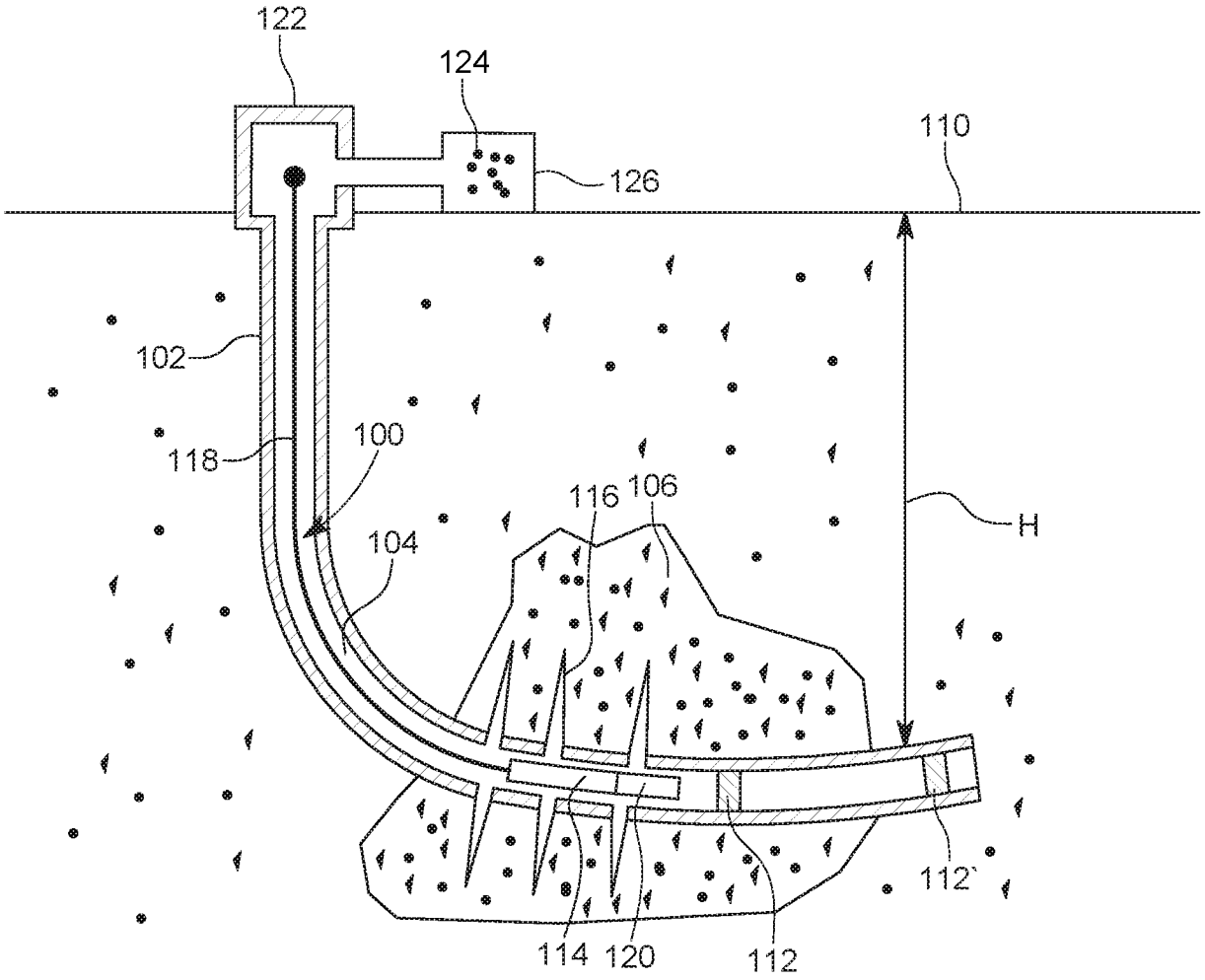
FIG. 1 (BACKGROUND ART)
FIG. 1 illustrates a well and associated equipment for well completion operations.
Figure 2:
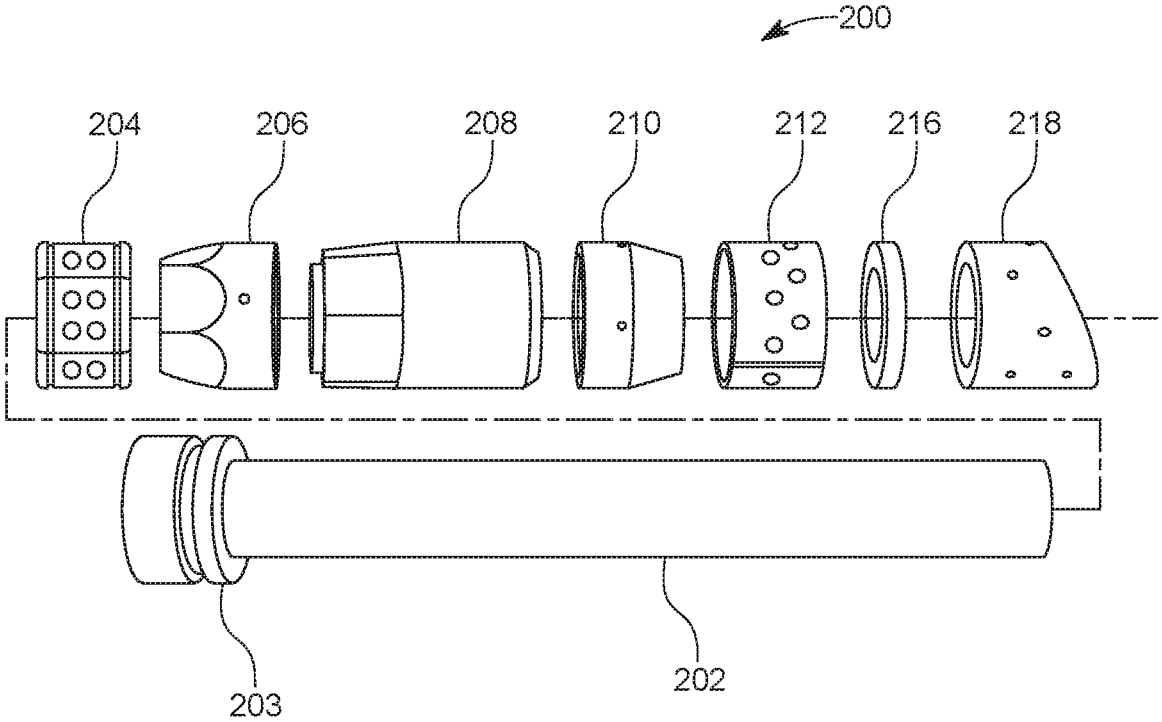
FIG. 2 (BACKGROUND ART)
FIG. 2 illustrates a traditional composite plug having an internal mandrel.
Figure 3:
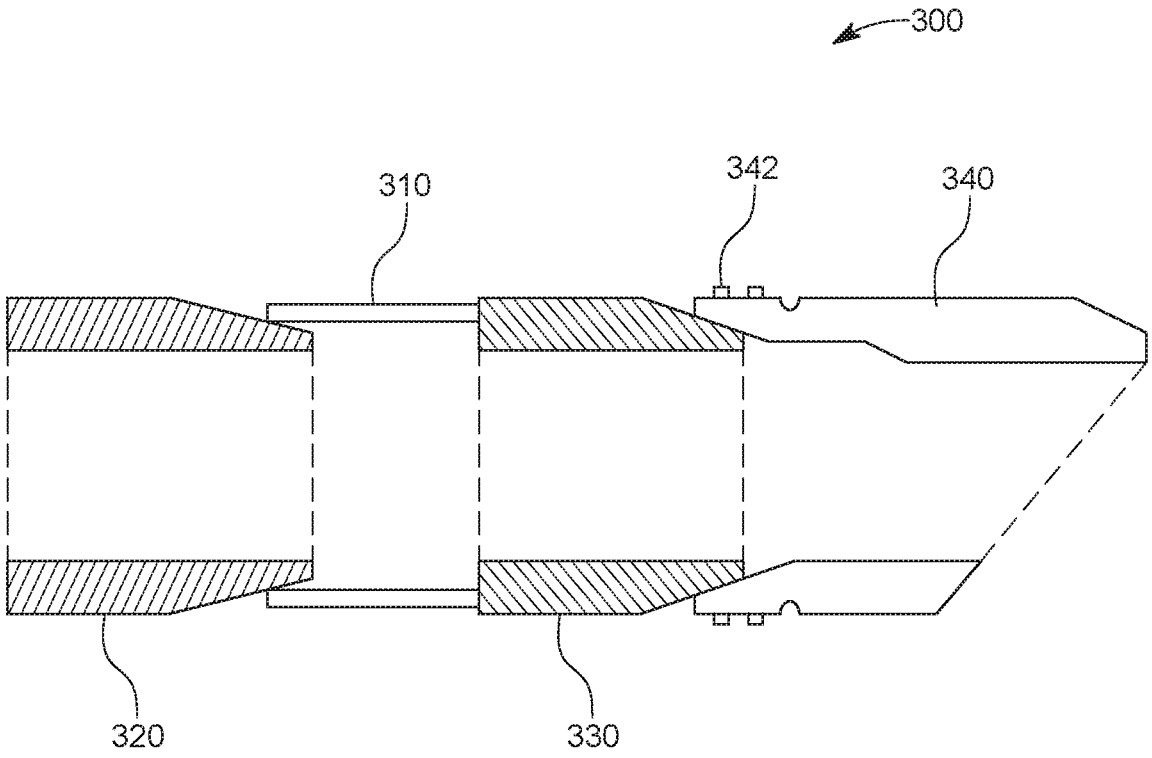
FIG. 3 illustrates a novel plug having no mandrel.

According to an embodiment illustrated in FIG. 3, a novel plug 300 is designed to have no mandrel for holding the various elements. Further, the novel plug 300 has, instead of an elastic sealing element, a plastically deformable sealing element 310, which once deformed, does not exert a force for returning to its initial state. Such a plastically deformable sealing element suffers an irreversible deformation once one or more wedges are acting on it. Such a plastically deformable sealing element may be made from one or more ductile materials, which are malleable. An example of such a material could be a metal, a plastic, a thermoplastic material, etc. In this regard, hard thermosetting plastics, rubber, crystals and ceramics are considered to not be a plastically deformable material. In one application, the plastically deformable sealing element may include an elastic component, for example, an elastic section and a brittle section. In this application, the elastic section is located toward the casing and the brittle section is located toward the bore of the plug.

The plug 300, in its minimal configuration, also includes a top wedge element 320 that is located upstream the sealing element 310. The terms "top" or "upstream" and "bottom" or downstream" are used herein interchangeably, and they relate to the head and toe, respectively, of the well in which the plug is placed. A central body 330 is placed downstream the sealing element 310, in direct contact with the sealing element. This element, as discussed later, has at least two purposes: first to prevent the sealing element from sliding downstream when the setting tool is actuating the plug, and second to push away the slips 342 (to be discussed later) when the plug is set. The plug 300 also includes a shoe 340 that is integrally formed with the slips 342. Thus, in this minimalistic configuration, the plug 300 includes four elements and no mandrel. The components of the plug 300 have a simply geometry, which makes these elements good candidates for a direct molding manufacturing process. The sealing element may be made not only from a plastically deformable material, but also from a material that is degradable when interacting with one or more of the fluids present in a well. For example, the sealing element may include an aluminum- or magnesium-based material, which is plastically deformable and degradable at the same time. In one application, the sealing element may include dissolvable plastics and/or dissolvable and degradeable materials.

Figure 4:
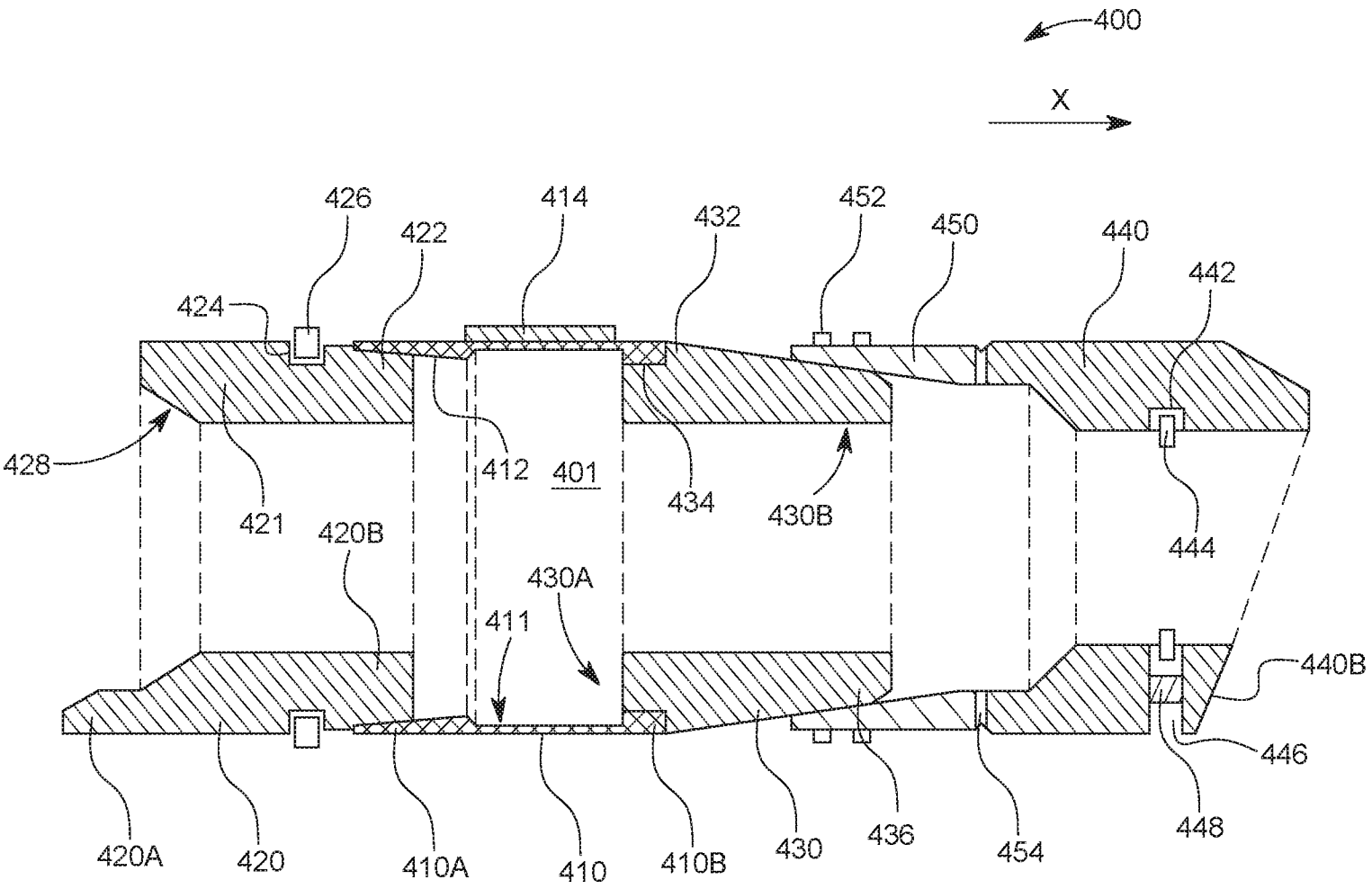
FIG. 4 illustrates details of the novel plug without a mandrel.

A more detailed view of a novel plug that has a plastically deformable sealing element and no mandrel is now discussed with regard to FIG. 4. Plug 400 includes the sealing element 410 sandwiched between the top wedge element 420 and the central body 430. Because no mandrel is present, the interior surface 411 of the sealing element 410 directly defines the plug's bore 401. Note that for the traditional plugs that have a mandrel, the mandrel defines the bore and not the added elements. Although the central body 430 includes the qualifier "central," this term is not used herein to limit this element to a central portion of the plug. Rather this term is used to indicate that element 430 is central to elements 410 and 440. Note that the central body 430 has a shoulder 432 and a groove 434 formed at the upstream end 430A that are configured to receive the downstream end 410B of the sealing element 410. Thus, when compressed between the upper wedge 420 and the central body 430, the sealing element 410 is prevented from moving along the longitudinal axis X, over or under the central body 430, because of the shoulder 432. This does not mean that in practice, due to unforeseen circumstances, the sealing element cannot occasionally move past the shoulder 432.

The sealing element 410 includes a plastically deformable material as previously discussed. This plastically deformable material is defined, as also discussed above, as being a ductile material, that suffers an irreversible deformation when the top wedge element and the central body swage it. However, it is possible to also use an elastic material, in addition to the plastically deformable material. In one application, the sealing element 410 includes a degradable material, which is also plastically deformable, so that the well fluid can degrade the sealing element after a given time. In another application, the sealing element 410 may be covered with a protective coating 414 as shown in FIG. 4. The protective coating 414 may cover the entire external surface of the sealing element 410. FIG. 4 schematically illustrates the presence of the protective coating 414 only on a portion of the sealing element. However, this schematic illustration should be construed to mean that the protective coating can partially or totally cover the sealing element. The coating prevents the plastically deformable material of the sealing element, from being exposed to the well fluid before the plug is set. Especially if the plastically deformable material is also a degradable material, the interaction between the sealing element and the fluids of the well need to be prevented before the sealing element is set. Once the plug is set, the coating 414 is compromised and the sealing element may start to degrade. The coating 414 may also be compromised during the milling of the plug rather than or in addition to the setting operation. When the plug is milled, the sealing element may be retained on the inside of the well's casing, which may then fully degrade over time. If non-degradable materials are used for the sealing element, the sealing element may be partially or totally milled such that the remaining restriction is negligible or not significant. In one application, the protective coating 414 may be elastomeric for additional sealing performance.

The upstream end 410A of the sealing element 410 extends over the wedge portion 422 of the top wedge element 420, as shown in FIG. 4. The wedge portion 422 of the top wedge element 420 receives the upstream end 410A and is designed (by making a non-zero angle relative to the longitudinal axis X) to promote an advance of the upstream end 410A of the sealing element 410 along the negative direction of the longitudinal axis X, over the external diameter of the top wedge element 420. In other words, the internal diameter of the upstream end 410A of the sealing element is slightly larger than the external diameter of the downstream end 420B of the top wedge element 420 so that, in its original, initial, state, the sealing element extends partially over the edge portion 422, as shown in FIG. 4. Due to the friction between the sealing element and the top wedge element, these two elements will stay connected to each other without the need of using one or more fasteners.

Further, the top wedge element 420 includes one or more pockets 424, formed in the body 421 of the top wedge element 420. In one embodiment, the pockets may communicate with each other so that a groove is formed around an external circumference of the top wedge element 420. These pockets 424 are used for accommodating corresponding locking buttons 426. If the pockets communicate with each other, the locking buttons may be replaced by a locking ring. The purpose of the locking buttons or locking ring is to engage with the interior part 412 of the sealing element 410, as will be discussed later, and to fix a position of the top wedge element relative to the sealing element. The locking buttons may be made from a tough material, for example, a metal.

The top wedge element 420 may also include a seat 428 located at the upstream end 420A. The seat 428 is manufactured into the body 421 for accommodating a ball (not shown), which may be used to close the plug. As shown in the figure, the seat 428 has surfaces slanted relative to the longitudinal axis X. While this is a desired feature for a plug, one skilled in the art would understand that this is not a necessary feature.

The central body 430 has a wedge portion 436 at the downstream end 430B, which is configured to engage with the slip element 450. The slip element 450 includes one or more protuberances 452, formed on the exterior surface of the slip element, as shown in FIG. 4. The protuberances 452 are formed from a material that is hard enough so that when the protuberances are pressed against the well's casing, they "bite" into the metal of the well's casing and fixedly engage with the wall of the casing. These protuberances will ensure that the plug does not move along the longitudinal axis X after the plug is set and large pressures are applied to the well.

Figure 5:
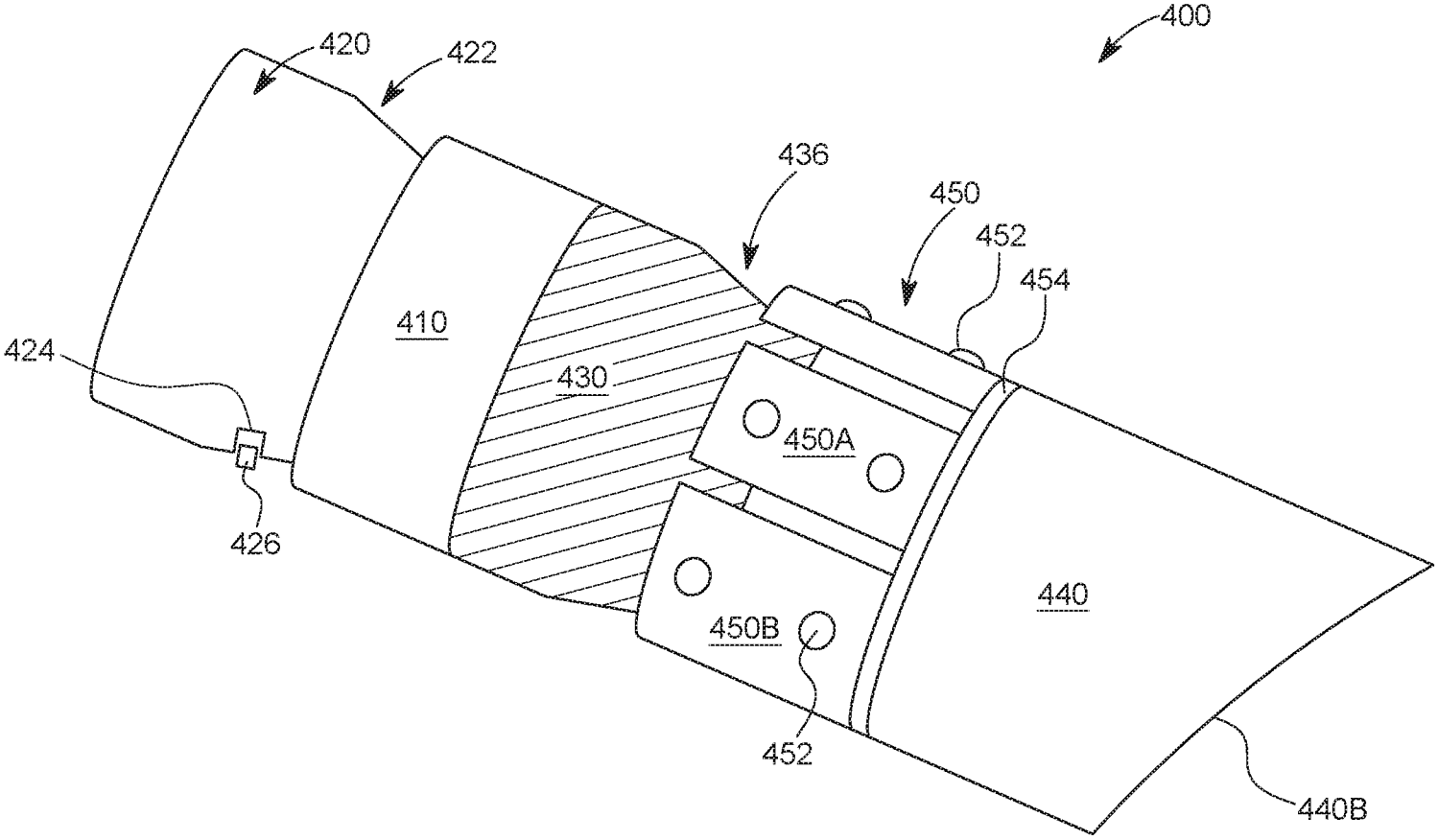
FIG. 5 is an overall view of a plug with no mandrel.

In this embodiment, the slip element 450 is formed integrally with the shoe 440. A groove 454 is formed between the slip element 450 and the shoe 440 so that the slip element can "petal" relative to the shoe, when the shoe is pushed toward the central body. In other words, as illustrated in FIG. 5, which shows an overview of the entire plug, the slip element 450 may be formed to have plural parts 450A, 450B, etc., each part is attached to the shoe 440 at the groove 454, but adjacent parts are not connected to each other. This ensures that when the slip element 450 moves up the wedge portion 436 of the central body 430, the various parts 450A, 450B can slightly bend at the groove, and move outward (radially) toward the casing of the well, so that the protuberances 452 of each part engages the casing. Thus, in this embodiment, the slip element 450 is integrated into the shoe 440, i.e., they are made of the same material during a same manufacturing step. In one application, both the slip element 450 and the shoe 440 are made of a composite material. However, it is possible to have the slip element 450 made separately, or from a different material. If the slip element 450 is made separately from the shoe, then the two components are separated at the groove 454, and in this case, a support element (for example a ring) may be needed for keeping the various parts 450A, 450B together.

The shoe 440 may be made of a composite material and its role is to provide a shape that engages another plug, during a milling operation, so that the plug does not rotate while being milled by the milling device. In the embodiments of FIGS. 4 and 5, the shoe 440 has a slanted downstream face 440B.

However, in these embodiments, the shoe 440 has an additional function, which is unique to this plug with no mandrel. The shoe 440 hosts a shear element 444 (see FIG. 4) that is configured to engage a mandrel of a setting tool (not shown) when the setting tool needs to set the plug. The shear element 444 is implemented in this embodiment as a shear ring 444 that is located in a trench/groove 442 formed in the body of the shoe. The shoe 440 has a lateral opening 446 through which the ring 444 may be inserted or retrieved into the shoe. The opening 446 may be blocked with a material 448 after the shear ring 444 is inserted to prevent it from exiting the shoe. The shear ring may be made of metal, composite, or any other material that would withstand the force applied by the setting tool for setting the plug. In one application, the shear element 444 is formed as a thread directly into the body of the shoe.

Figure 6:
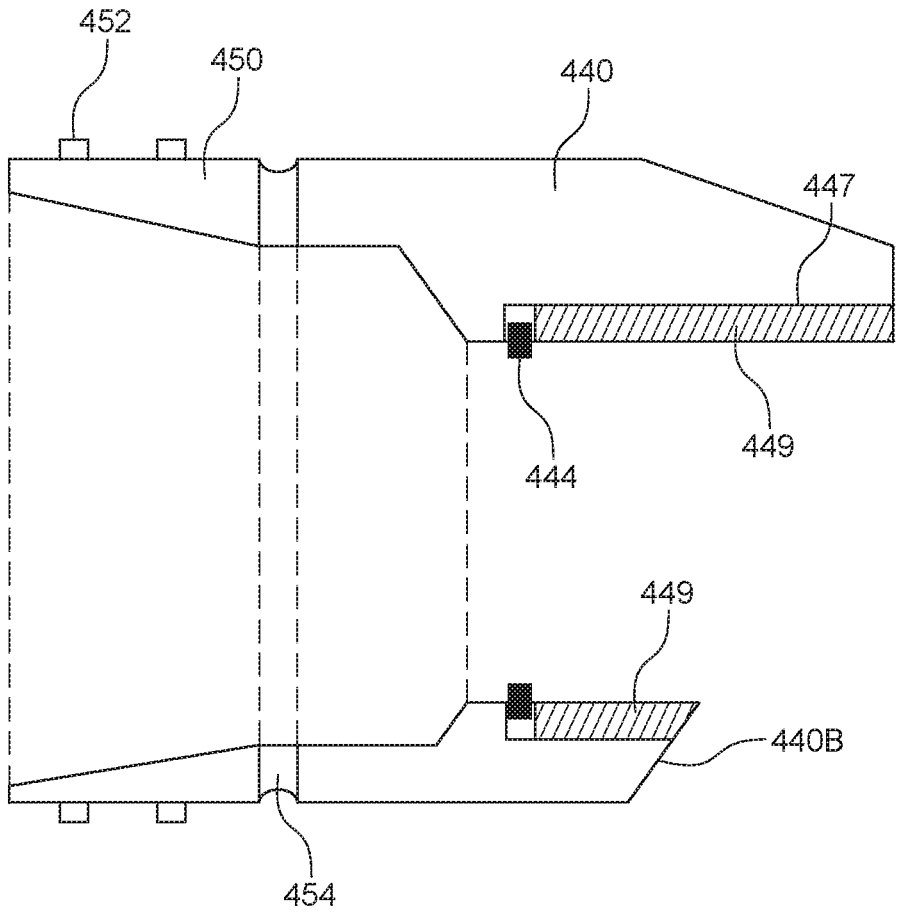
FIG. 6 illustrates a shoe of a plug formed integrally with a slip element.

In one embodiment, as illustrated in FIG. 6, the shear ring 444 is attached to the shoe from the downstream face 440B. For this embodiment, there is a portion removed from the interior part of the shoe 440 to form an opening 447. The opening 447 has a diameter equal to the external diameter of the shear ring 444. After the shear ring 444 is inserted inside the opening 447, a retaining ring 449 is inserted into the opening 447, to keep the shear ring 444 inside the shoe. The retaining ring 449 may be glued to the interior of the shoe 440. The shear element 444 may also be implemented as shear pins, where one or more of these pins are inserted into the internal diameter of the shoe.

Figure 7:
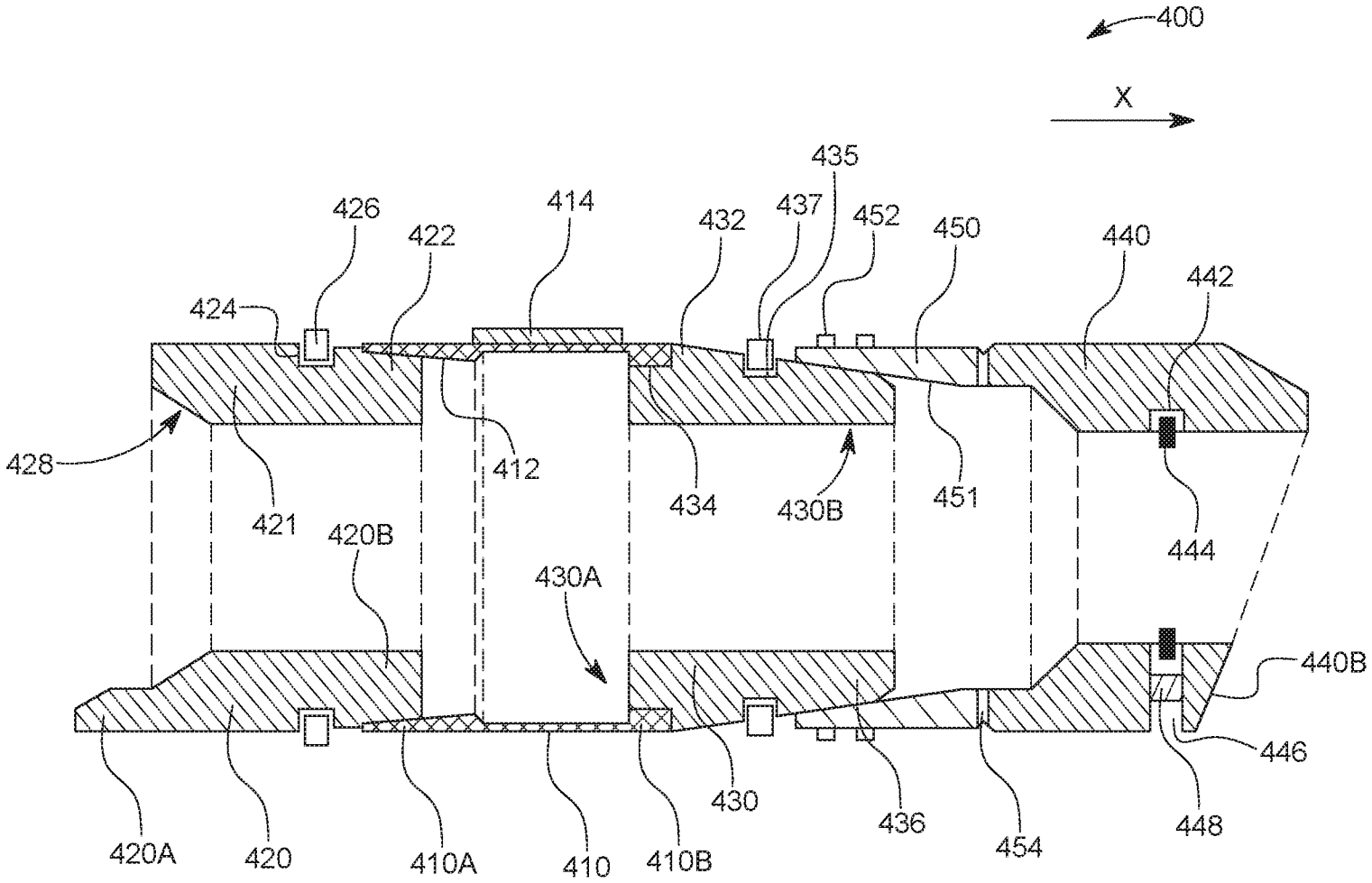
FIG. 7 illustrates a plug having no mandrel, but having plural locking buttons.

In still another embodiment, which is illustrated in FIG. 7, the central body 430 may include one or more pockets 435, formed in its body. In one embodiment, the pockets may communicate with each other so that a groove is formed around an external circumference of the central body 430. These pockets 435 are used for accommodating corresponding locking buttons 437. If the pockets communicate with each other, the locking buttons may be replaced by a locking ring. The purpose of the locking buttons or locking ring is to engage with the interior part 451 of the slip element 450, as will be discussed later.

Figure 8:
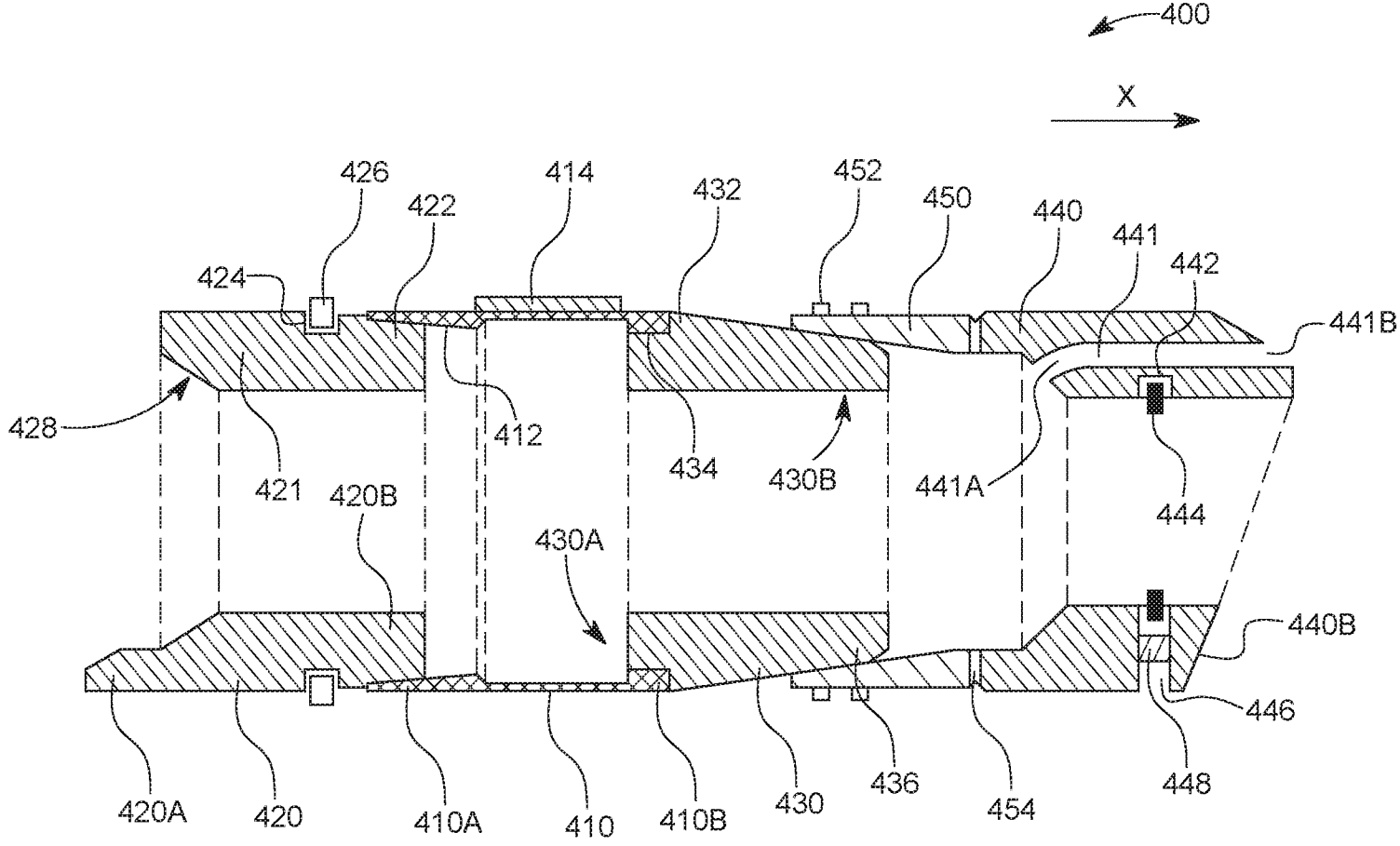
FIG. 8 illustrates a plug having no mandrel, but having a shear element to engage a setting tool.

In still another embodiment, as illustrated in FIG. 8, the shoe 440 has one or more passages 441 formed through the body of the shoe. Passage 441 is shown in FIG. 8 as extending from an interior point 441A, which corresponds to the bore of the plug, to a point 441B, which corresponds to an interior of the well's casing, past the plug. In this way, when the bore of the shoe 440 is blocked by a ball (as will be discussed later), production fluid still can pass through the plug.

Figure 9:
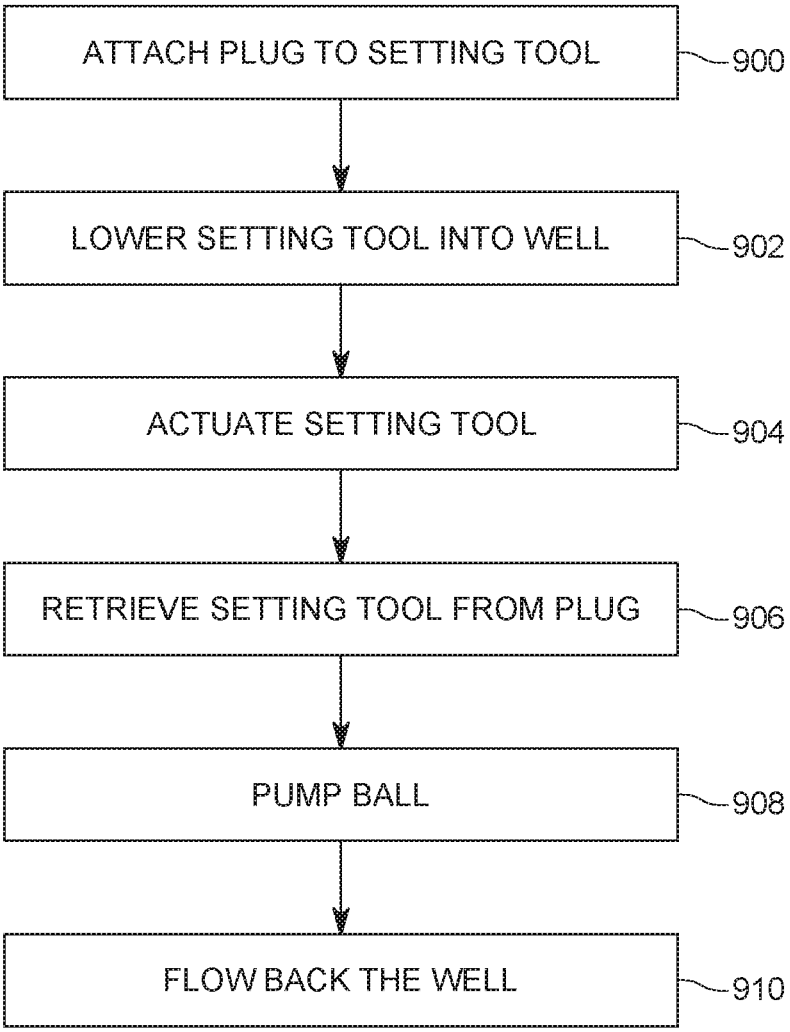
FIG. 9 is a flowchart of a method for setting a plug with no mandrel.
Figure 10:
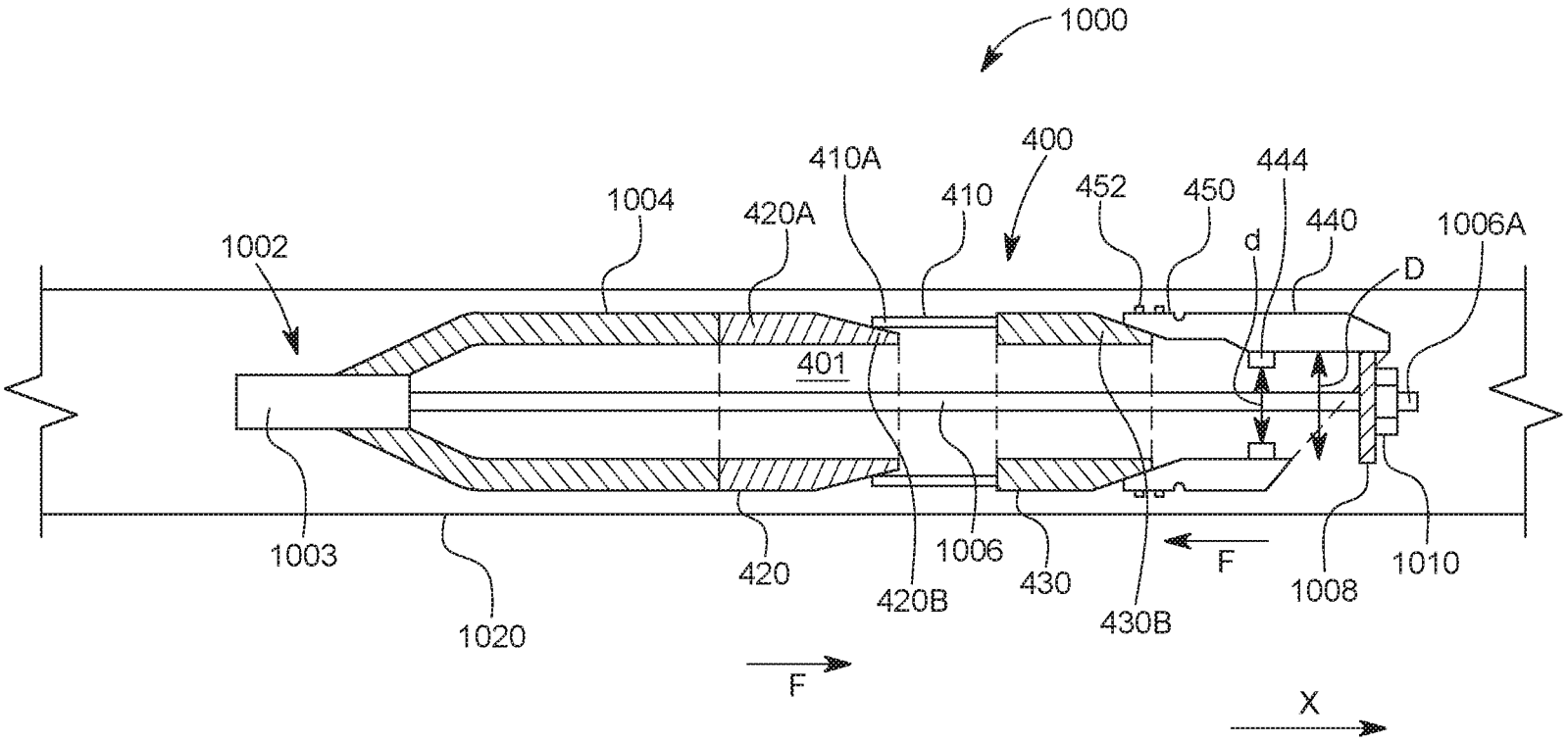
FIG. 10 illustrates a setting tool connected to a plug with no mandrel.

A method for setting the plug 400 discussed above is now discussed with regard to FIG. 9. In step 900, a setting tool 1002, which is illustrated in FIG. 10, is attached to the plug 400. FIG. 10 shows the system 1000 including the setting tool 1002 and the plug 400 already attached to each other. The setting tool 1002 includes a setting sleeve 1004 that contacts the upstream end 420A of the top wedge element 420. A mandrel 1006 of the setting tool 1002 extends all the way through the bore 401 of the plug 400, until a distal end 1006A of the mandrel exits the shoe 440. A disk or nut 1008 is attached to the distal end 1006A of the mandrel. If a disk is used, then a nut 1010 may be attached to the mandrel 1006 to maintain in place the disk 1008. An external diameter D of the disk 1008 is designed to fit inside the bore of the shoe 440, but also to be larger than an internal diameter d of the shear ring 444 or another element (e.g., a collet) that may be used for engaging the mandrel.

In step 902, the system 1000 is lowered into the well's casing 1020, at a desired position. Then, in step 904, the setting tool 1002 is actuated by known means, which are not discussed herein. As a result of this step, the mandrel 1006 is pulled toward the main body 1003 of the setting tool 1002, thus applying a force F on the shoe 440. The setting tool sleeve 1004 prevents the plug 400 from moving along the longitudinal axis X of the casing 1020, thus applying a reactionary force F on the top wedge element 420. Because there is a force F applied to the shoe 440 by the disk 1008 and an opposite force F applied by the sleeve 1004 to the top wedge element 420, these two elements start to move toward each other.

Figure 11:
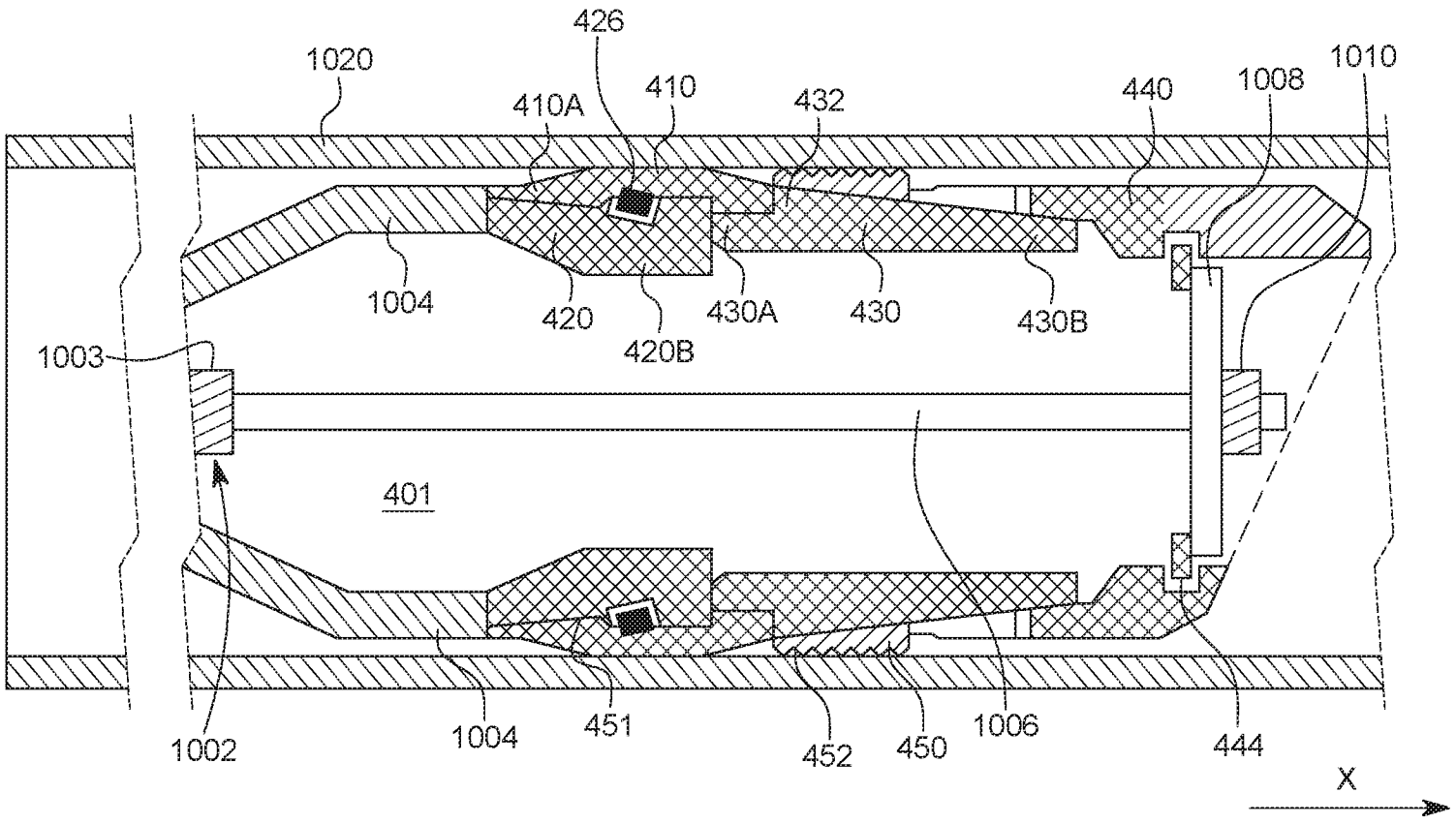
FIG. 11 illustrates a plug, with no mandrel, after being set in a well.

During this process, as illustrated in FIG. 11, the downstream end 420B of the top wedge element 420 slides under the upstream end 410A of the sealing element 410 and the slip element 450 slides over the downstream end 430B of the central body 430. FIG. 11 shows that the protuberances 452 of the slip element 450 are now in direct contact with the casing 1020 as they are pushed toward the casing by the wedge portion of the central body 430. Further, FIG. 11 shows that the sealing element 410 was pushed toward the casing 1020 so that no fluid passes between the plug and the casing, i.e., the plug is set.

FIG. 11 shows that the entire sealing element 410 is now backed by the top wedge element 420 and the central body 430, so that the sealing element is forced to expand toward the casing 1020 and not toward the bore of the plug. In this way, the present plug does not need a mandrel to back the sealing element. To keep this new configuration in place, the locking buttons 426 placed in and around the top wedge element 420 have slid under the sealing element 410 and are in direct contact with the back surface 451 of the sealing element 410. This engagement locks in place the sealing element 410 and the top wedge element 420, i.e. these two elements behave now like one, so that one element is preventing from sliding along the longitudinal axis X relative to the other. The locking buttons 426 may be made of a hard material (for example, metal) so that they slightly enter into the back surface of the sealing element 410 and stay there, i.e., they do not slip relative to the sealing element.

Because the slip element 450 has engaged the casing 1020 with the protuberances 452, the slip element 450 is locked relative to the casing. This means that the entire plug is now locked in the casing (i.e., the plug is set) and the sealing element 410 is fixedly maintained in place. Different from a traditional plug that has the sealing element made of an elastic material, the present sealing element is made of a plastically deformable material. This means that once the sealing element 410 has been deformed to contact the casing 1020, as shown in FIG. 11, there is no need to have the top wedge element 420 locked relative to the casing on one side, in addition to the shoe 440 being locked relative to the casing on the other side. In other words, for a plastically deformable sealing element, there is a need of only one locking element, i.e., the slip element 450 of the shoe 440, as the plastically deformable sealing element does not try to return to its original state.

This arrangement is advantageous relative to the traditional plugs because when the plug needs to be removed, there is no internal mandrel to be milled out, which is typically the largest part of the plug. Thus, a time for removing the plug is greatly decreased. In addition, the manufacturing and assembly process of the novel plug is easier and shorter as there are fewer parts. Not lastly, the novel plug advantageously has a larger bore than the existing plugs as the mandrel is not present.

Figure 12:
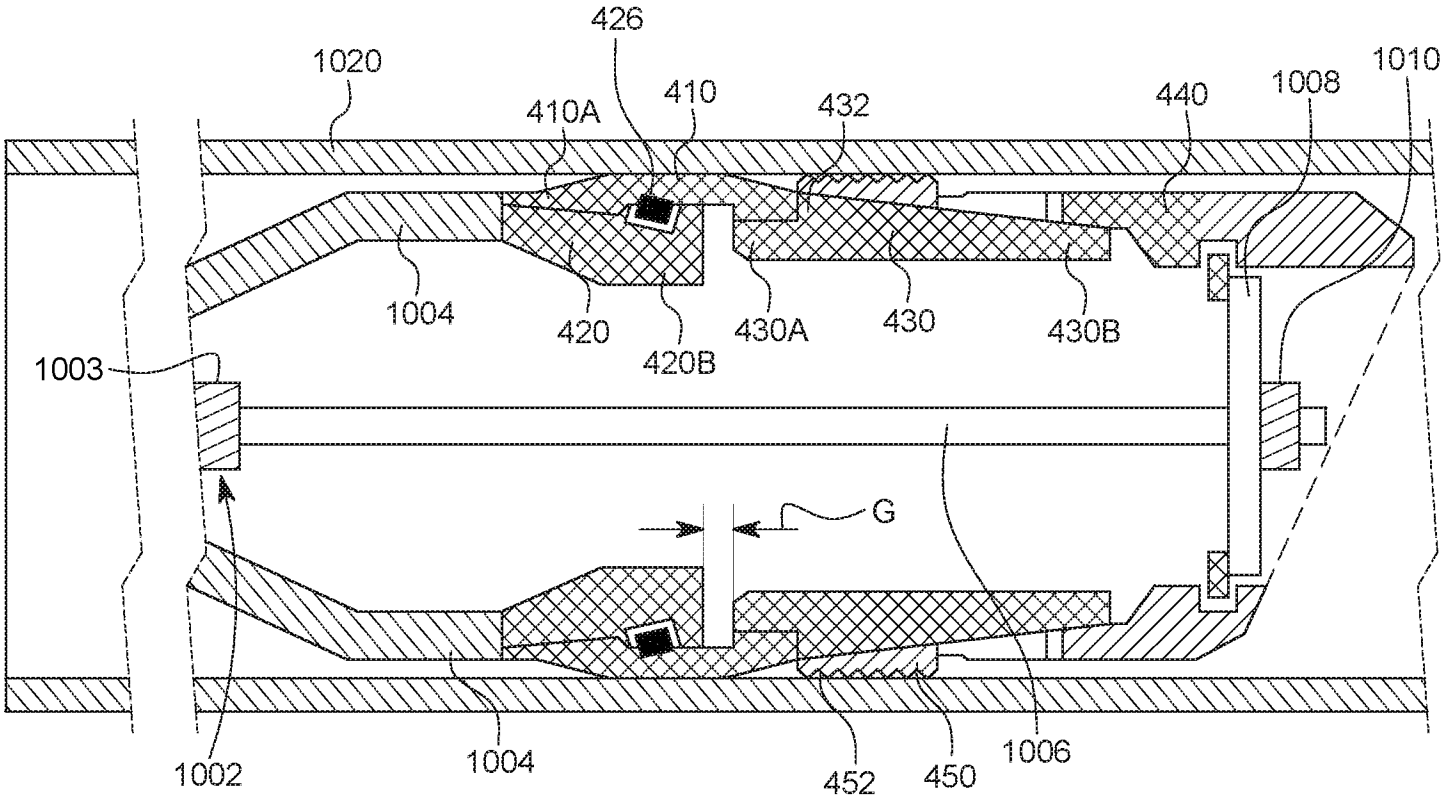
FIG. 12 illustrates another plug with no mandrel after being set in a well.

While FIG. 11 shows the upstream end 430A of the central body 430 being in direct contact with the downstream end 420B of the top wedge element 420, it is possible, as shown in FIG. 12, to also have a gap G between the central body 430 and the top wedge element 420. Although this gap G might allow part of the sealing element 410 to expand into the gap instead of expanding toward the casing 1020, this embodiment illustrates that the remaining part of the sealing element has expanded toward the casing, and thus, even such embodiment is achieving the goal of sealing the well.

Figure 13:
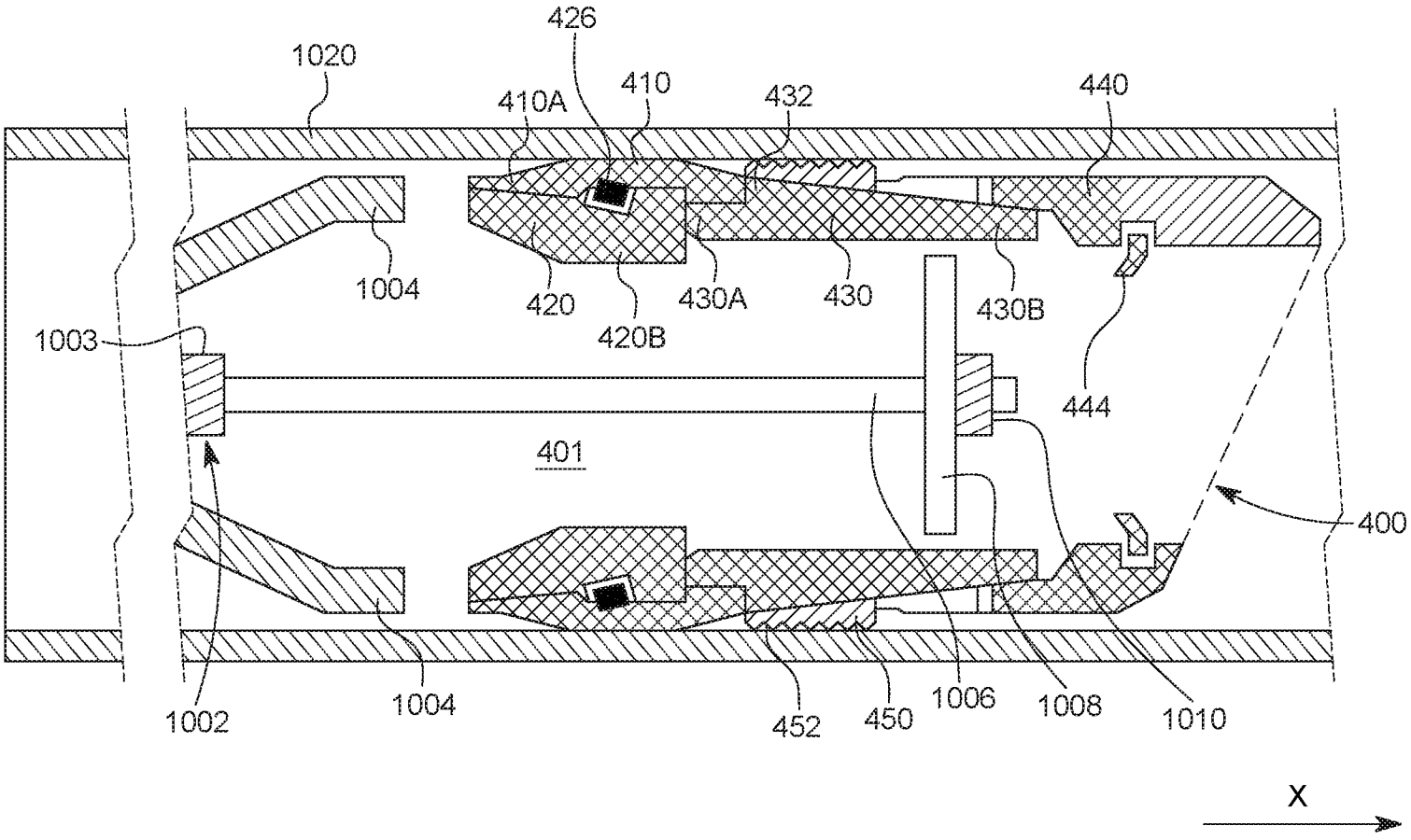
FIG. 13 illustrates the plug with no mandrel after a shearing element is broken by the setting tool.
Figure 14:
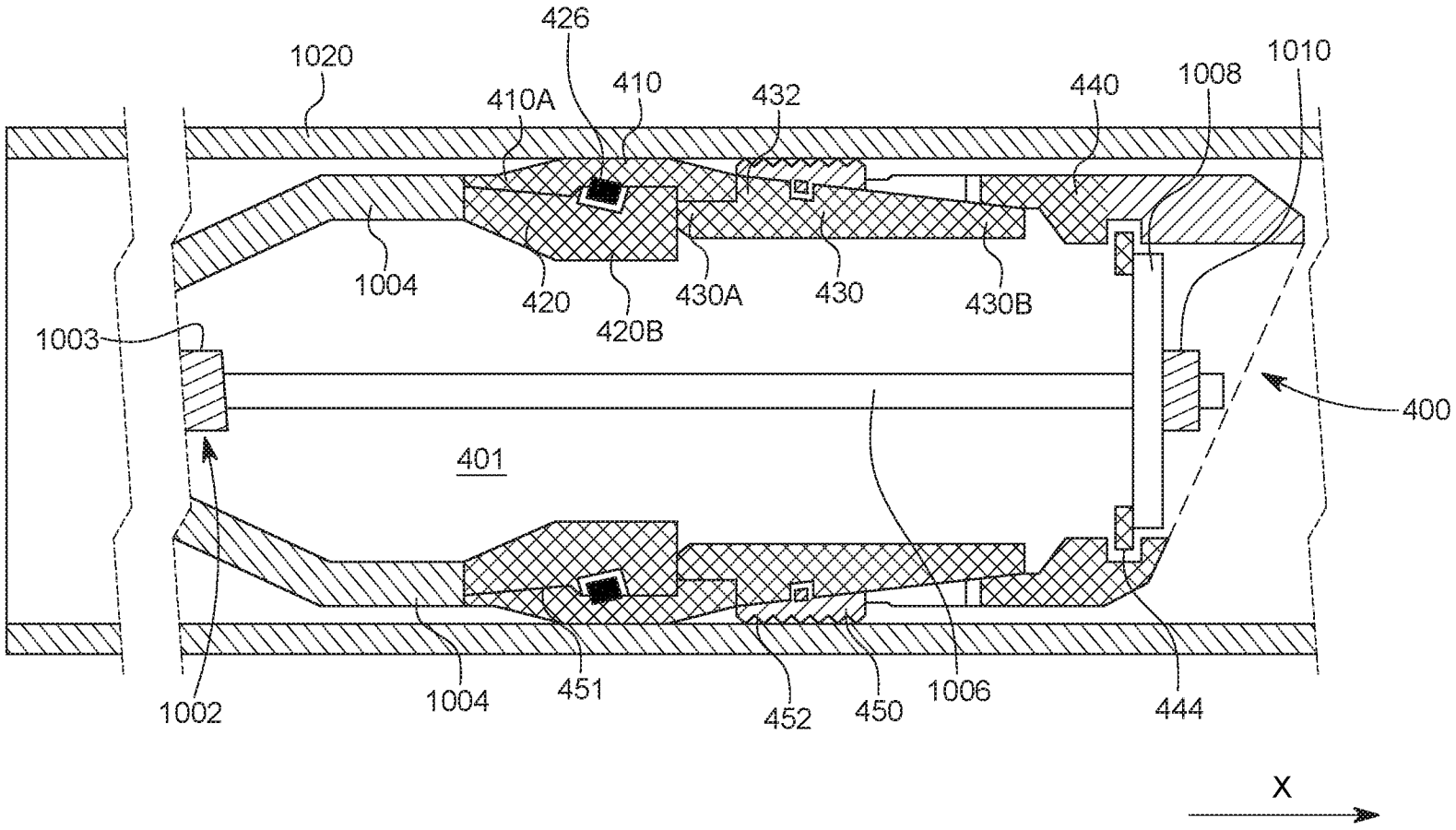
FIG. 14 illustrates a plug with no mandrel, but with multiple locking buttons.

Still with regard to FIG. 11, it is noted that the disk 1008 has engaged the shear ring 444. While the mandrel 1006 is pulled toward the body 1003 of the setting tool 1002, and the sleeve 1004 of the setting tool is preventing the top wedge element 420 from moving along the longitudinal axis X, a great force is exerted by the disk 1008 on the shear ring 444. The material and dimensions of the shear ring 444 are selected in such a way that the shear ring will withstand the setting force applied by the mandrel 1006 until the sealing element is deformed to seal the casing. The setting force is defined, in one application, as the force necessary to make the top wedge element 420 to touch the central body 430. When this condition happens, the shear ring 444 gives way and the disk 1008 moves past the shear ring as illustrated in FIG. 13, thus being freed from the shear ring. FIG. 13 schematically illustrates the shear ring 444 being broken due to the force applied by the disk 1008 and the sleeve 1004 moving away from the top wedge element 420. At this time, the operator can decide to retrieve in step 906 the setting tool from the well as the mandrel 1006 and disk 1008 are freed from the plug 400. Note that although the disk 1008 and the sleeve 1004 are not applying any force F on the plug, the plug remains set as the plastically deformable sealing element 410 does not exert any force on the top wedge element or the central body for returning to its original state because the sealing element has been irreversibly deformed to its new state and also because the slip element has engaged the casing. If the plug 400 shown in the embodiment of FIG. 7 is used, then the locking buttons 437 of the central body 430 are also engaging the back of the slip element 450, as illustrated in FIG. 14. This action further enhances the connection of the slip element to the casing and the bond between the central body and the slip element.

Figure 15:
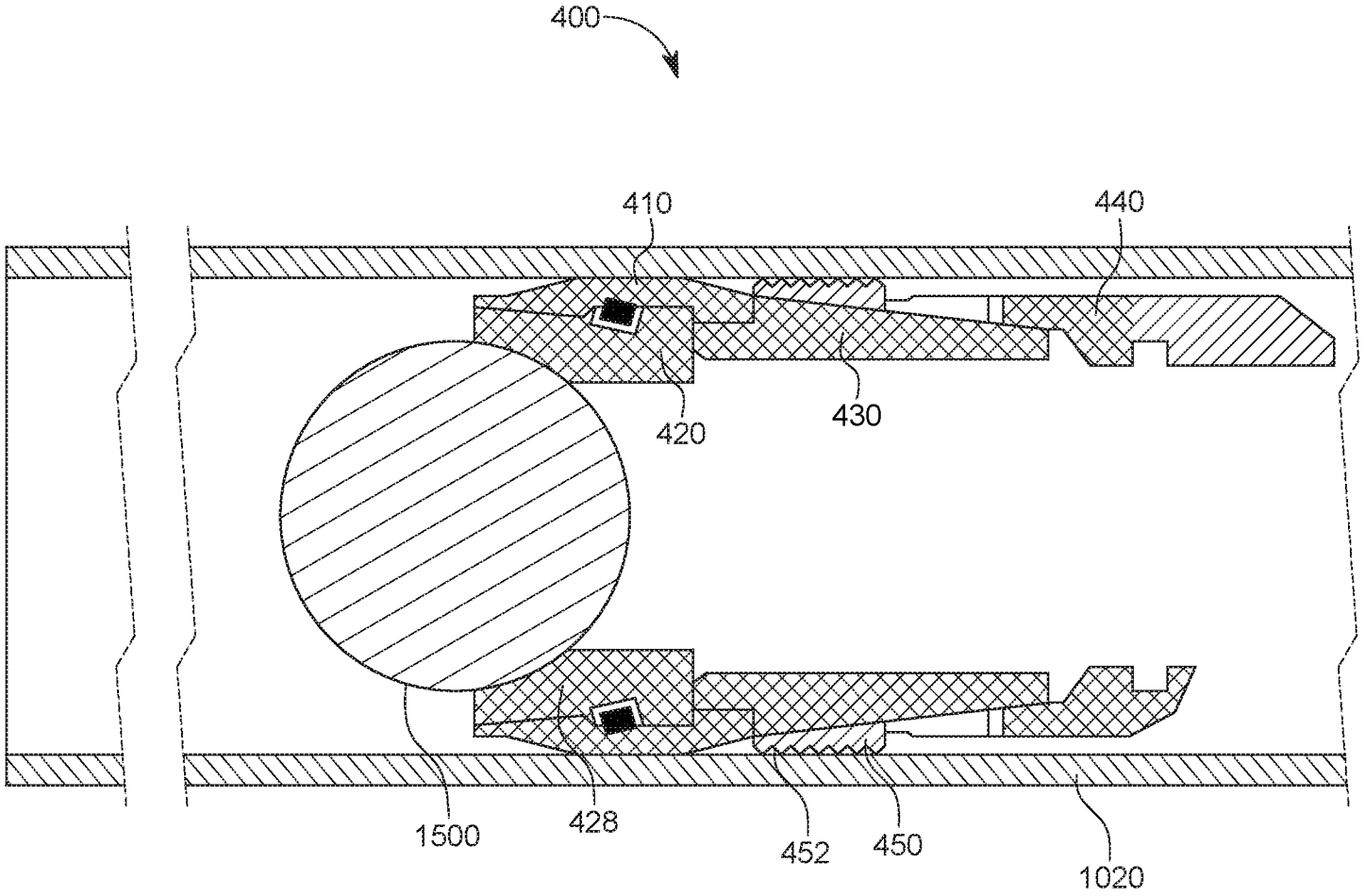
FIG. 15 illustrates a ball that closes an upstream end of a plug with no mandrel.

Next, the operator pumps down the well, in step 908, a ball 1500 that would seat on the seat 428 formed in the top wedge element 420, as illustrated in FIG. 15. The ball 1500 may be made of a degradable material, or to have various passages through the entire body or only partially through the body, so that it can degrade quicker when interacting with the well fluids. At this time, the plug 400 has fully sealed the well for any fluid that is pumped from upstream of the plug.

Figure 16:
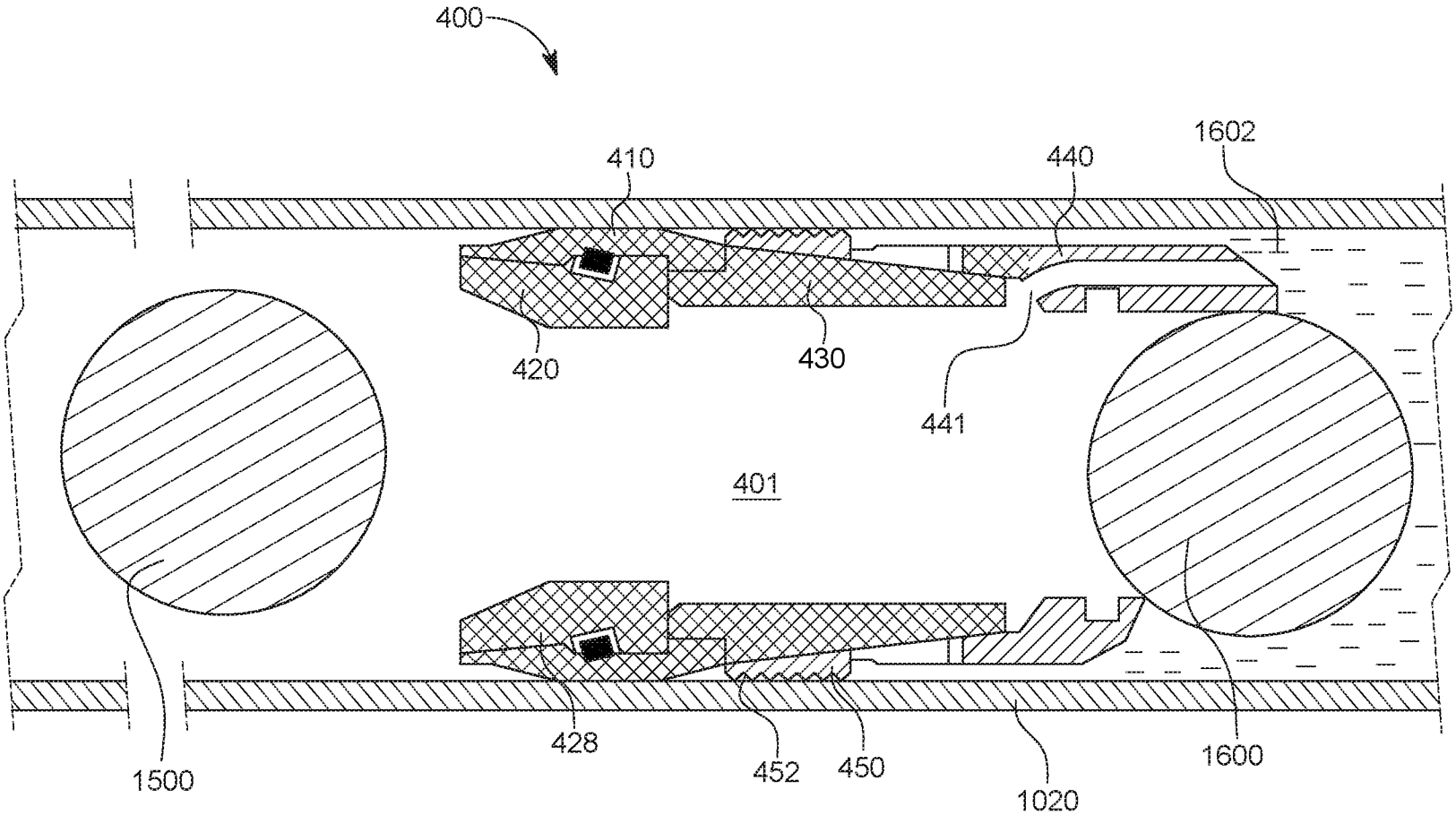
FIG. 16 illustrates a plug with no mandrel being closed at a downstream end by a ball.

The operator may later, in step 910, decide to flow back the well. This means that the pressure upstream the set plug is reduced below the pressure downstream the plug so that fluids from the formation around the well enter the casing and flow up the casing. If this happens, the ball 1500 in FIG. 15 moves upstream from the plug 400, as illustrated in FIG. 16. However, if another plug has been deployed below the current plug 400, a ball 1600 associated with that plug is moving toward the shoe 440 and blocks it, as illustrated in FIG. 16. Thus, for this situation, if the ball 1600 has not degraded enough to pass through the bore 401 (which is a large bore) of the plug 400, the one or more passages 441 (discussed above with regard to the embodiment of FIG. 8) formed in the shoe 440 allow the well fluids 1602 to bypass the ball 1600 and move upstream.

As previously discussed, the bore 401 of the novel plug is large comparative to a traditional plug that has an inner mandrel. According to an embodiment, a ratio of an inner diameter of the central body 430 to an inner diameter of the casing 1020 ranges from 0.5 to 0.99. For example, for a 4.75 in inner diameter casing, the smallest inner diameter or opening of the novel plug 400 ranges from 2.33 inches to 4.2 inches. The large diameter of the bore of the plug enables substantial fluid flow during production with a smaller restriction. Conventional plugs generally provide large restrictions or smaller inner diameter (1-2 inches) for enabling fluid flow. However, the plug 400 provides for a larger inner diameter such that there is not a substantial loss in flow during production. In addition, the plug may be milled much faster than a conventional plug. This is so not only because there is no mandrel inside the plug, but also because the various elements of the plug are made of materials that do not pose a high resistance to the milling process. In this regard, the top wedge element, the central body and the shoe may be made of composite materials. In one application, these elements may be made of glass reinforced high temperature nylon (wounded, injection molded, extruded, pultrusion, or combination of any of these manufacturing methods), Kevlar fiber composite, carbon fiber composite, other composite. Other methods may be used, as projection molded, injection molded over metal inserts. The locking buttons may be made of cast iron, rubber, ceramic, ductile metals, degradable metals or polymers.

Returning to the embodiment illustrated in FIG. 4, it is noted that the various components (four in this case) are kept together by the friction between them. In other words, there is no need to physically attach the top wedge element 420 to the sealing element 410, or the sealing element 410 to the central body 430, or the central body 430 to the shoe 440 as these elements exhibit enough friction to stay together. The current production method of composite plugs leaves a thin, slick surface finish on the molded components. This allows the top wedge component or the central body of the plug 400 to enter deeper behind the sealing element or the slip element 450, respectively, generating more compressive stress on these members. This in turn may cause plug failure below the performance requirements as well as leads to unpredictability in the failure point of these elements.

Figure 17:
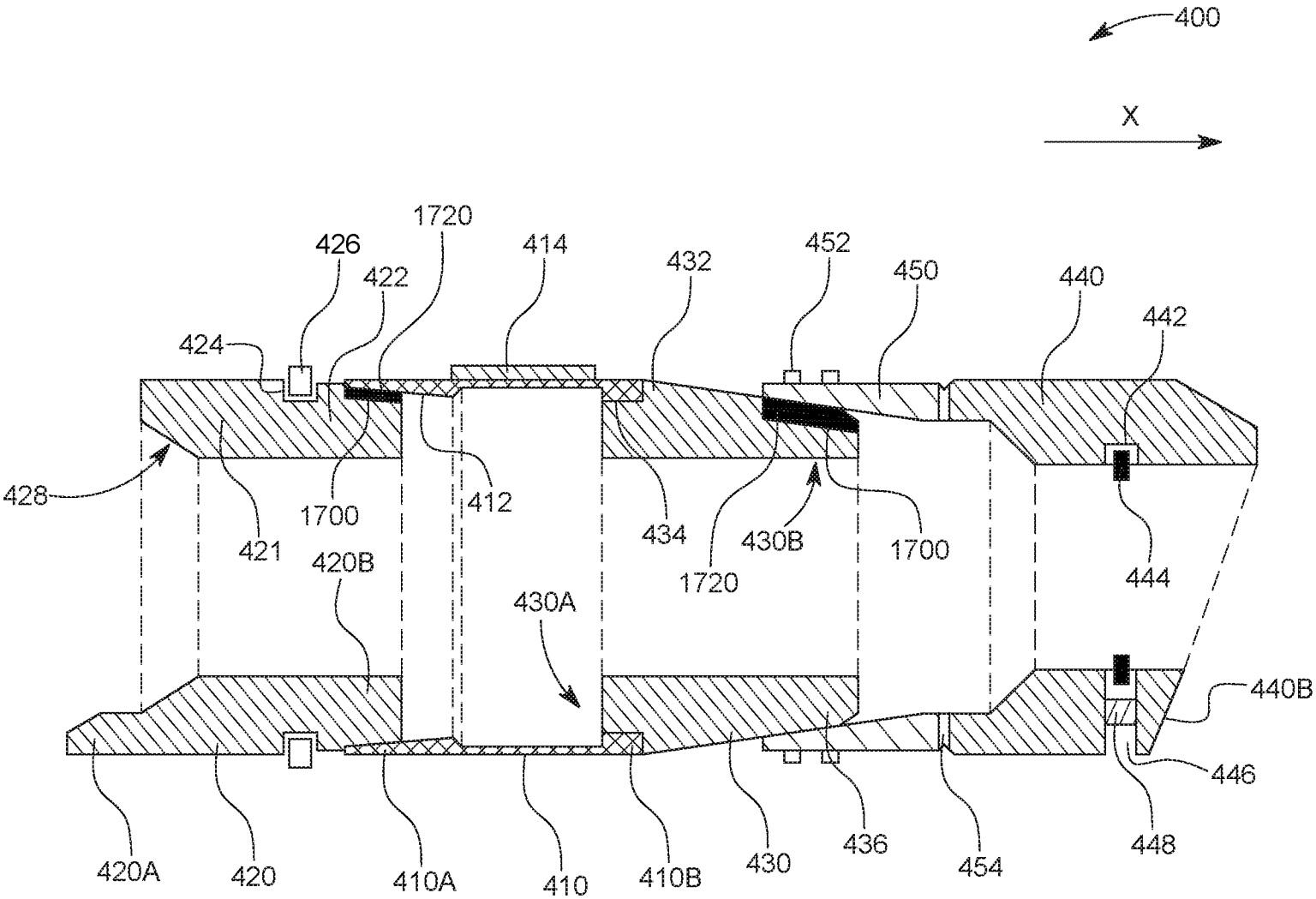
FIG. 17 illustrates a plug having one or more surfaces treated to increase a coefficient of friction.

Thus, according to an embodiment illustrated in FIG. 17, a surface contact 1700 between the slip element 450 and the wedge portion 436 of the central body 430 and/or a surface contact 1710 between the top wedge element 420 and the sealing element 410, is coated with a material 1720 that enhances the friction between these surfaces. This material would prevent the slipping of one element relative to the other one. The material 1720 may be an epoxy-based coating with suspended particulate matrix that generates a much higher coefficient of friction between the two surfaces. This higher coefficient of friction in turn leads to a greater force required to drive one element deeper behind the other element. While this increased friction decreases the chance of one element sliding under an adjacent one while the plug is not set, the increased friction force would be easily overcome by the force F applied by the setting tool to set the plug. The composition of the coating material 1720 may include a solvent suspension with added silica. The solvent suspension may also include coarse ceramic beads or powder, or steel grindings or coarse chips, in essence, any material that would increase the friction with another surface.

In one application, instead of adding the coating material 1720 to one of the elements noted above, the molded skin of one of these elements may be removed to increase the coefficient of friction. In another application, particulate matter can be added to the mold cavity when forming the composite elements so that these particles increase the friction when in contact with another surface. In still another application, explicit grooves can be cut in one of the surfaces that form the surface contacts 1700 or 1710. These cuts would also increase the sliding shear stress between the surfaces. Although these methods for increasing the friction between surfaces in contact in a plug have been discussed with regard to the novel plug 400, the same methods may be applied to any known plug, even those that use an internal mandrel. The methods may be used on a plug irrespective of the type of material used to make the components of the plug.

The disclosed embodiments provide methods and systems for providing a plug with increased bore and reduced milling time. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A downhole isolation tool for sealing a well when activated by a setting tool, the downhole isolation tool comprising:

a sealing element having an internal surface that defines a bore of the downhole isolation tool;

a top wedge element having a downstream end located within an upstream end of the sealing element;

a central body that has a shoulder configured to accommodate a downstream end of the sealing element;

a shoe; and a slip element, wherein the slip element is partially located over an exterior circumference of a downstream end of the central body, wherein the sealing element is sandwiched between the top wedge and the central body, and wherein the sealing element includes a plastically deformable material that irreversibly deforms when swaged.

2. The downhole isolation tool of claim 1, wherein the sealing element is sandwiched directly between the top wedge element and the central body.

3. The downhole isolation tool of claim 1, wherein the top wedge element and the central body are made of composite materials.

4. The downhole isolation tool of claim 1, wherein the shoe and the slip element are formed as a single part.

5. The downhole isolation tool of claim 1, wherein the slip element includes plural protuberances located on an outside surface to engage a casing of the well.

6. The downhole isolation tool of claim 1, wherein the shoe includes a groove for receiving a shear element.

7. The downhole isolation tool of claim 6, wherein the groove is formed into an inside surface of the shoe.

8. The downhole isolation tool of claim 6, further comprising:

the shear element, which extends outside the groove into the bore of the downhole isolation tool and is configured to engage a disk of a setting tool.

9. The downhole isolation tool of claim 8, wherein the shear element is a shear ring.

10. The downhole isolation tool of claim 8, wherein the shear element is configured to break at a given force.

11. The downhole isolation tool of claim 6, wherein the shoe has a side opening that corresponds to the groove, and the shear element fits through the side opening to be placed inside the groove.

12. The downhole isolation tool of claim 1, wherein the top wedge element has a pocket in which a locking button is located so that the locking button engages the interior surface of the sealing element when the downhole isolation tool is set.

13. The downhole isolation tool of claim 1, wherein the central body has a pocket in which a locking button is located so that the locking button engages an interior surface of a slip element.

14. A downhole isolation tool for sealing a well when activated by a setting tool, the downhole isolation tool comprising:

a sealing element having an internal surface that defines a bore of the downhole isolation tool;

a top wedge element having a downstream end located within an upstream end of the sealing element;

a central body that has a shoulder configured to accommodate a downstream end of the sealing element;

a shoe and a slip element formed as a single part, and the slip element is partially located over an exterior circumference of a downstream end of the central body, wherein the sealing element is sandwiched between the top wedge and the central body and includes a plastically deformable material that irreversibly deforms when swaged.

15. The downhole isolation tool of claim 14, wherein the slip element includes plural protuberances located on an outside surface to engage a casing of the well.

16. The downhole isolation tool of claim 14, wherein the shoe includes a groove for receiving a shear element.

17. The downhole isolation tool of claim 16, wherein the groove is formed into an inside surface of the shoe.

18. The downhole isolation tool of claim 16, further comprising:

the shear element, which extends outside the groove into the bore of the downhole isolation tool and is configured to engage a disk of a setting tool.

19. The downhole isolation tool of claim 16, wherein the shoe has a side opening that corresponds to the groove, and the shear element fits through the side opening to be placed inside the groove.

20. The downhole isolation tool of claim 14, wherein the top wedge element has a pocket in which a locking button is located so that the locking button engages the interior surface of the sealing element.

21. The downhole isolation tool of claim 20, wherein the central body has a pocket in which a locking button is located so that the locking button engages an interior surface of the slip element.

22. The downhole isolation tool of claim 14, wherein the shoe has an interior passage that bypasses a portion of the bore defined by the shoe.

23. The downhole isolation tool of claim 14, wherein at least one surface of the top wedge element, the sealing element, the central body, and the slip element is treated to increase a coefficient of friction.

24. A method for setting a downhole isolation tool in a casing of a well, the method comprising:

attaching the downhole isolation tool to a mandrel of a setting tool;

lowering the downhole isolation tool and the setting tool to a desired depth inside the casing;

actuating the setting tool so that the mandrel is pulled toward a sleeve of the setting tool, to plastically deform a sealing element of the downhole isolation tool;

pushing a top wedge element of the downhole isolation tool, having a downstream end located within an upstream end of the sealing element, into the sealing element; and pushing a central body, having a shoulder configured to accommodate a downstream end of the sealing element, into the sealing element to plastically deform the sealing element, wherein the sealing element has an internal surface that defines a bore of the downhole isolation tool, and wherein the sealing element includes a plastically deformable material that irreversibly deforms when swaged by the sleeve and the mandrel.

25. The method of claim 24, further comprising:

pushing the top wedge element and the central body toward each other until they contact with each other.

26. The method of claim 25, further comprising:

further pulling the mandrel of the setting tool until the mandrel shears a shearing element located in a shoe of the downhole isolation tool.

27. The method of claim 24, further comprising:

pushing the entire top wedge element inside the sealing element.

28. The method of claim 24, further comprising:

locking the top wedge element inside the sealing element with locking buttons distributed on an outside surface of the top wedge element.

29. The method of claim 24, further comprising:

pushing with the mandrel a shoe toward the sealing element, wherein the shoe is formed integrally with a slip element that includes plural protuberances that are forced against the casing.

30. The method of claim 24, wherein the top wedge element has a pocket in which a locking button is located so that the locking button engages the interior surface of the sealing element.

31. The method of claim 24, wherein the central body has a pocket in which a locking button is located so that the locking button engages an interior surface of the slip element.

32. The method of claim 24, further comprising:

pumping a ball to a seat formed in the top wedge element.

33. The method of claim 24, wherein the shoe has an interior passage that bypasses a portion of the bore defined by the shoe.

34. The method of claim 24, further comprising:

treating at least one surface of the top wedge element, the sealing element, the central body, and the slip element to increase a coefficient of friction.

* * * * *